US006209449B1

(12) United States Patent
Otto et al.

(10) Patent No.: US 6,209,449 B1
(45) Date of Patent: Apr. 3, 2001

(54) ARRANGEMENT OF PROCESSING DEVICES, IN PARTICULAR OF CROSS-STRAPPING DEVICES, AND METHOD FOR OPERATING THE ARRANGEMENT

(75) Inventors: Marcel Otto, Soest; Robert Amse, Loosdrecht, both of (NL)

(73) Assignee: Ferag Verpakkingstechniek B.V., Soest (NL)

( * ) Notice: Subject to any disclaimer, the term of this patent is extended or adjusted under 35 U.S.C. 154(b) by 0 days.

(21) Appl. No.: 09/258,958

(22) Filed: Mar. 1, 1999

(30) Foreign Application Priority Data

Mar. 3, 1998 (CH) ..... 0504/98

(51) Int. Cl.[7] ..... B65B 13/02

(52) U.S. Cl. ..... 100/2; 53/399; 53/582; 100/4; 100/7; 100/14

(58) Field of Search ..... 100/2, 4, 7, 8, 100/14, 15, 26; 53/399, 582

(56) References Cited

U.S. PATENT DOCUMENTS

| | | | | |
|---|---|---|---|---|
| 3,085,501 | * | 4/1963 | Wimmer | 100/14 |
| 3,350,998 | * | 11/1967 | Brown et al. | 100/14 |
| 3,568,591 | | 3/1971 | Dunlap . | |
| 3,589,275 | | 6/1971 | Van de Bilt . | |
| 3,667,378 | | 6/1972 | Van de Bilt . | |
| 3,901,138 | * | 8/1975 | Bilt | 100/14 |
| 4,977,827 | * | 12/1990 | Chandhoke et al. | 100/14 |
| 5,078,057 | | 1/1992 | Pearson . | |

FOREIGN PATENT DOCUMENTS

| | | |
|---|---|---|
| 31 40 291 | 4/1983 | (DE) . |
| 3248788 | 2/1986 | (DE) . |
| 3303956 | 8/1987 | (DE) . |
| 0894721 | 3/1999 | (EP) . |
| 1 498 021 | 1/1968 | (FR) . |

* cited by examiner

*Primary Examiner*—Stephen F. Gerrity
(74) *Attorney, Agent, or Firm*—Oppedahl & Larson LLP

(57) ABSTRACT

Two per se known cross-strapping devices (10, 11) to which packages or bundles (1, 2 . . . 5) to be strapped are supplied in a conveying direction (F) in which one package or bundle at a time is positioned and crosswise strapped and out of which strapped packages or bundles are conveyed in the same conveying direction (F), are arranged in direct succession and are operated as a "tandem" by supplying two packages or bundles (1, 2), one to each one of the devices, by simultaneously strapping them and by conveying them away again simultaneously. For this purpose, a mutual control mode is necessary in which mutual control mode, in the two devices conveying steps (b) are carried out alternating with strapping steps (a) whereby the conveying stroke (2*h*) of the conveying steps is twice as long as when operating one only device. Compared to a single cross-strapping device, the arrangement has an increased performance and requires a minimal amount of additional space. Furthermore, it offers a limited performance also for the case of one of the devices not being operative in which case the other device is operated as a single device without substantial additional effort. The arrangement is suitable also for other processing devices which can be operated in alternating processing and conveying steps.

4 Claims, 3 Drawing Sheets

ARRANGEMENT OF PROCESSING DEVICES, IN PARTICULAR OF CROSS-STRAPPING DEVICES, AND METHOD FOR OPERATING THE ARRANGEMENT

The invention concerns an arrangement of processing devices, each processing device comprising processing means, conveying means and individual control means and each processing device being equipped for conveying an object into the device by a conveying stroke in a conveying direction, for processing the object in the device and for conveying the object out of the device by a conveying stroke in said conveying direction. The arrangement comprises a plurality of processing devices, in particular of devices for cross-strapping. The invention further concerns a method according to the generic part of the corresponding independent claim and serving for operating the arrangement.

BACKGROUND

The term "processing device" is to be understood as a device to which individual objects are supplied in series from one side, in which one object after the other undergoes processing and from which processed objects are conveyed away on the opposite side. Such processing devices are usually equipped with device parts for processing the objects and with device parts for conveying the objects through the device and the device is controlled to alternatingly process and convey. Processing may consist of only one processing step or of a plurality of successive part-steps. An example for this kind of processing device is a strapping device for crosswise strapping of substantially parallelepipedic packages or bundles.

The most various devices for strapping substantially parallelepipedic packages or bundles are known. These are devices with the help of which a tape, a string-like item or a film material is laid around the package or bundle and is then tightened and closed. Normally, a package or bundle is conveyed into such a device from one side, is positioned in a defined strapping position by a correspondingly arranged stop, is strapped and after strapping, is conveyed out of the device in the same direction, whereby a successive package is simultaneously supplied and positioned.

Devices of the kind named above are equipped in various manner. In the simplest of these devices, such as e.g. described in the publications U.S. Pat. No. 3,589,275 or U.S. Pat. No. 3,667,378, the packages or bundles are strapped transversely, i.e. substantially perpendicular to the supplying and conveying away direction either just once or possibly several times to produce a plurality of parallel transverse strappings. For crosswise strapping, i.e. for producing at least two strappings at right angles to each other, two of the mentioned devices are operated in succession. The packages receive a first strapping in the first device, and for the second strapping are then conveyed into the second device whereby the conveying path comprises a turn of 90° or the objects are rotated by 90°, e.g. with a rotating device according to U.S. Pat. No. 3,901,138. With an arrangement of two such relatively simple devices a high output is achieved. If, however, one of the two devices fails, strapping must be stopped completely or the packages must, after the first strapping be resupplied to the still operable device by hand. With the help of an operator it is then possible to achieve at the most half of the usual output.

Cross-strapping devices are also known, i.e. devices in which a package or a bundle is strapped at least twice in a crosswise manner in two successive strapping steps or in substantially simultaneous strapping steps, whereby at least one strapping perpendicular to the conveying direction and at least one strapping parallel to the conveying directions is produced. In such devices, the packages or bundles are e.g. strapped perpendicular to the conveying direction, are then rotated by 90° and are again strapped perpendicular to the first strapping. Such devices are e.g. described in the publication DE-3248788. The packages can also be supplied to a strapping device with one diagonal positioned parallel to the conveying direction and be cross-strapped in two strapping steps (direction of strapping oblique in relation to the conveying direction) which strapping steps at least partly overlap each other temporally whereby the object does not need to be moved between the strapping steps (e.g. described in publication DE-3303956). In a similar manner devices are operated in which the packages are strapped perpendicular to the conveying direction and in parallel to it without intermediate movement (quasi simultaneous transverse and parallel strapping), whereby the two strapping steps again advantageously overlap temporally at least partly. Such devices are e.g. described in the publication U.S. Pat. No. 5,078,057 or in the Swiss patent application No. 01631/97.

The so called cross-strapping devices as named above have the advantage of requiring considerably less space than an arrangement of two devices for transverse strapping only and comprising a rotation device between the two strapping devices. The performance of such cross-strapping devices (in cross-strapped packages per time unit) is, however, in most cases less than the performance of an arrangement of two devices for transverse strapping because in the latter arrangement the strapping steps can be absolutely simultaneous, which is not possible in the named cross-strapping devices. Furthermore, if a cross-strapping device is inoperative it is not possible even using personnel to maintain at least part of the output. In such a case, the packages or bundles must be stored intermediately or processing upstream of the strapping device must be interrupted.

In order to achieve higher output for cross-strapping carried out by strapping devices or, in general, to achieve higher output of processing devices according to the above definition and/or for reducing loss of processing through failure of such devices, it is known to arrange and operate two or possibly more than two such devices in parallel and to allot the objects to be processed to each of the devices by means of a switchpoint upstream of the devices. Using such an arrangement, the performance (in cross-strapped packages or generally speaking in processed objects per time unit) is increased, compared to one single such device, by a factor corresponding to the number of installed devices. If one of the devices fails the operation of the other devices is not impaired and at least part of the performance can be maintained. In such a case merely the switchpoint control needs to be altered. The disadvantage of this kind of arrangement is not only the fact that the switchpoint must be purchased, installed and maintained as an additional device but also the fact that the switchpoint and the parallel conveying means to and from the devices require a considerable amount of space, space which is usually not easily available, in particular when installations are extended. In the case of strapping devices, distribution to the parallel strapping devices prolongs the conveying path for packages or stacks which are not yet strapped. This is an important disadvantage in particular for not very stable stacks.

The object of the invention is to create an arrangement of per se known processing devices, in particular of cross-strapping devices, and to show a method for operating the arrangement, whereby compared to one only similar device, the inventive arrangement and the operating method are to give an increased performance as well as an increased security against loss of performance due to failure, but whereby, again compared to one single device the arrangement needs only a minimum of additional space and a minimum of additionally necessary conveying path.

SUMMARY OF THE INVENTION

The inventive arrangement e.g. consists of two cross-strapping devices. These are arranged immediately behind each other, i.e. in series and they are operated in a "tandem"-manner such that each one is simultaneously supplied with a package or bundle, that in each one crosswise strapping is carried out simultaneously and that from each one a cross-strapped package or bundle is conveyed away simultaneously and in the same time in which further packages or bundles to be strapped are supplied to each one of the devices. With two successive cross-strapping devices operated in the described tandem manner slightly less than double the performance (in cross-strapped packages per time unit) of one single cross-strapping device can be achieved. Twice the performance cannot be achieved because the conveying steps for supplying the packages or bundles and for conveying them out of the two devices arranged in series requires slightly more time than this is the case for one single device. On the other hand, the space required in addition corresponds to merely the base area of the second device and not a single further device is to be installed.

If one of the devices of the inventive arrangement fails (failure of the processing function), the other device continues processing by being operated as a single device. Therefore, the arrangement has at least two control modes and corresponding control means: in the one control mode (mutual control mode) both devices are mutually controlled (for tandem operation) and in the other control mode (individual control mode) one device is operated individually whereby advantageously in the other one the conveying function is operative through a corresponding automatic control. An automatic change from mutual to individual control mode is advantageous for the case that one of the devices fails.

DESCRIPTION OF THE DRAWING

The inventive arrangement of processing devices and the method for operation of the arrangement are described in more detail in connection with the following Figures on the example of two cross-strapping devices. This in no way means that the inventive arrangement and the inventive device is to be restricted to cross-strapping devices.

DETAILED DESCRIPTION

Figure 1:
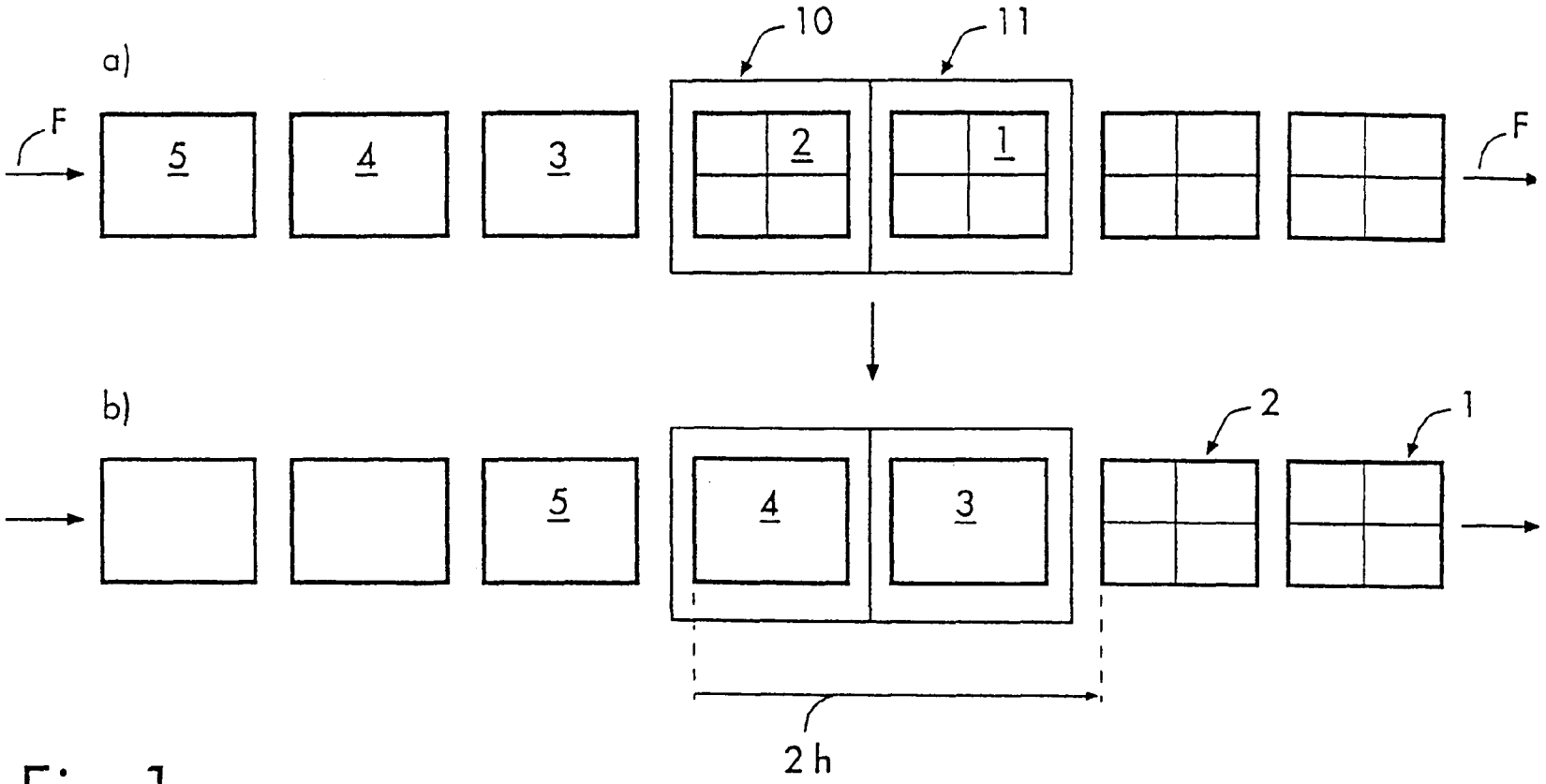
FIG. 1 shows a diagram of the tandem operation of two cross-strapping devices arranged in series immediately behind each other (processing step a and conveying step b)

FIG. 1 shows in a very diagrammatic representation the inventive arrangement and the inventive operation method for two cross-strapping devices 10 and 11. The two cross-strapping devices are per se known devices such as are e.g. described in the publications mentioned above. The packages or bundles (1, 2 . . . 5) to be strapped are conveyed into such devices in a conveying direction F through an inlet and they are conveyed out of an outlet opposite the inlet in the same conveying direction F. For the stepwise conveying of the packages to be strapped and of the strapped packages, the cross-strapping devices normally comprise a conveying means (e.g. a belt conveyor) which conveying means takes over the packages or bundles from an upstream conveying means, positions the packages or bundles in a strapping position and conveys the packages or bundles to a downstream conveying means. For the positioning of an object to be strapped precisely in the strapping position, the devices further comprise a positioning means, e.g. a correspondingly controlled stop which is positioned in the conveying path when an object is to be positioned and is removed from the conveying path when the object is to be conveyed away.

In FIG. 1, the cross-strapping devices are shown very diagrammatically as rectangles, the means for conveying and for positioning are not shown.

In the inventive arrangement, the two cross-strapping devices are arranged such that the second device 11 follows the first device 10 immediately downstream in conveying direction F such that the outlet of the first device 10 substantially constitutes the inlet into the second device 11.

Two packages 1 and 2 are simultaneously strapped crosswise in a strapping step a) one in each of the two devices 10 and 11. This strapping step a) which takes place simultaneously in both devices may be a combined transverse/parallel strapping or it may be a strapping sequence (transverse strapping/rotation/transverse strapping). In any case, a package positioned in one of the devices is strapped to completion and is only then conveyed further. In a conveying step b), the two cross-strapped packages 1 and 2 are removed, whereby the necessary conveying stroke 2*h* is twice the conveying stroke necessary when operating a single device. Two further packages 3 and 4 to be strapped are conveyed into the devices by the same double conveying stroke 2*h*, i.e. in the same time interval in which the strapped packages 1 and 2 are removed from the devices. The strapping step a) in this kind of tandem operation requires the same amount of time as when operating a single device. The conveying step b) requires a larger amount of time than in the single device operation because of the larger conveying stroke. Due to this the performance of the tandem is not quite double the performance of two individually (e.g. in parallel) operated, identical cross-strapping devices.

For the tandem operation, the conveying means of the cross-strapping devices are to be controlled for carrying out a conveying stroke which is twice the conveying stoke of the single device operation. The positioning means are to be controlled such that they allow passage of two packages in each conveying step b) by means of, e.g., being removed from the conveying path, and such that they are active for each third package, e.g. by being moved into the conveying path. In comparison, in single device operation, the positioning means allows passage of one package in each conveying step and becomes active for every second package.

In an operation method according to FIG. 1, the processing steps are controlled in the same manner as in single device operation and in the conveying steps a double conveying stroke is carried out.

From FIG. 1 it is obvious that in the same manner as the shown two cross-strapping devices, more than two, e.g.

three cross-strapping devices can be arranged and operated, whereby the necessary conveying stroke must, in any case, correspond to the conveying stroke of the single device operation multiplied by the number of devices arranged in series after each other.

Figure 2:
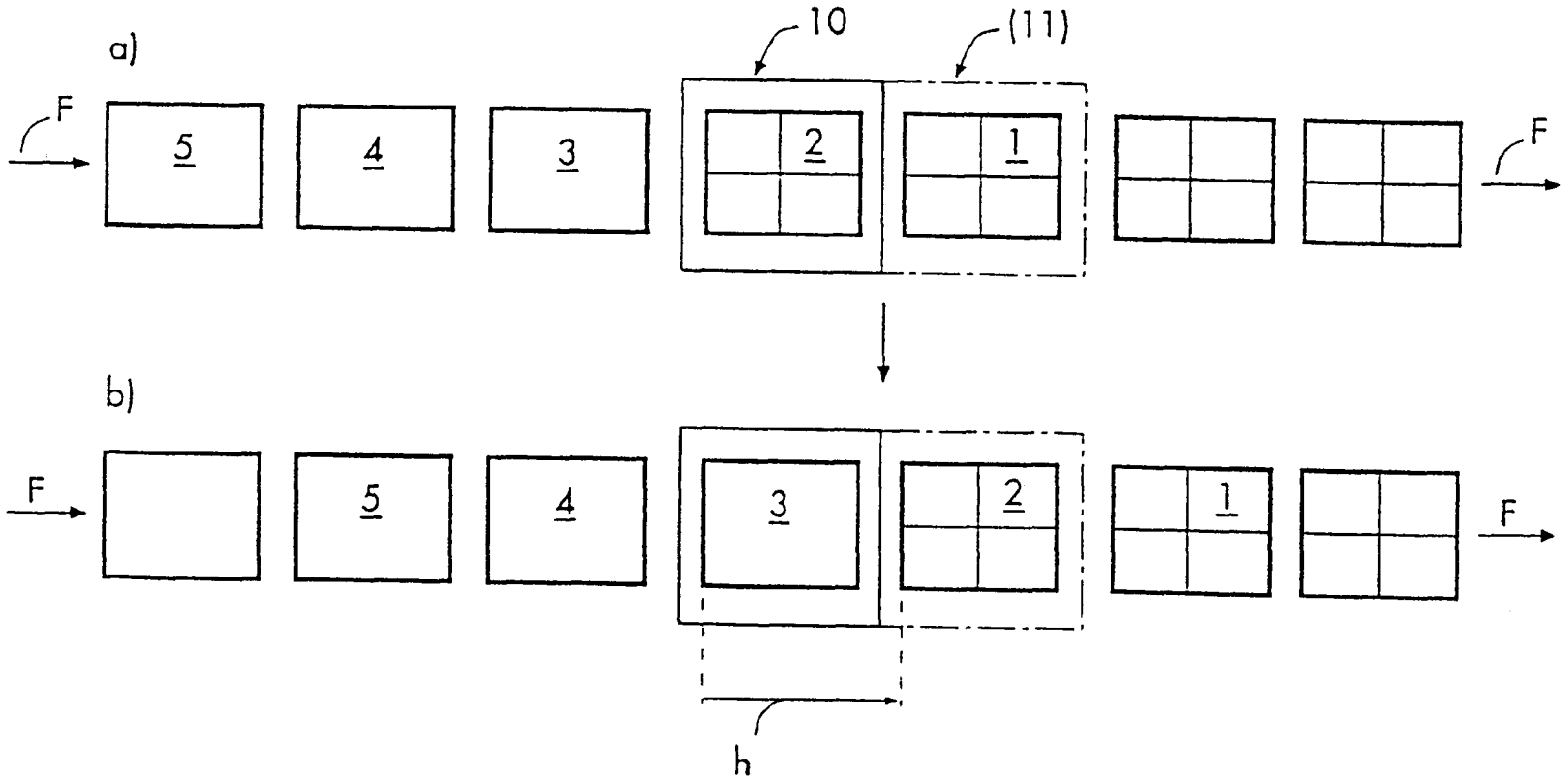
FIG. 2 shows a diagram for operation of the arrangement according to FIG. 1 when only one of the two cross-strapping devices is operative (processing step a and conveying step b)

FIG. 2 illustrates, again as a strapping step a) and a conveying step b), the operation of the tandem arrangement according to FIG. 1, for the case in which the strapping function of one of the two devices 10 or 11, e.g. of the second device 11 is not operative (e.g. defect). In such a case it is useful to use a smaller conveying stroke h and to operate the positioning means of the operative device as in single device operation. Such an individual operation mode allows the same performance as one independent device.

Figure 3:
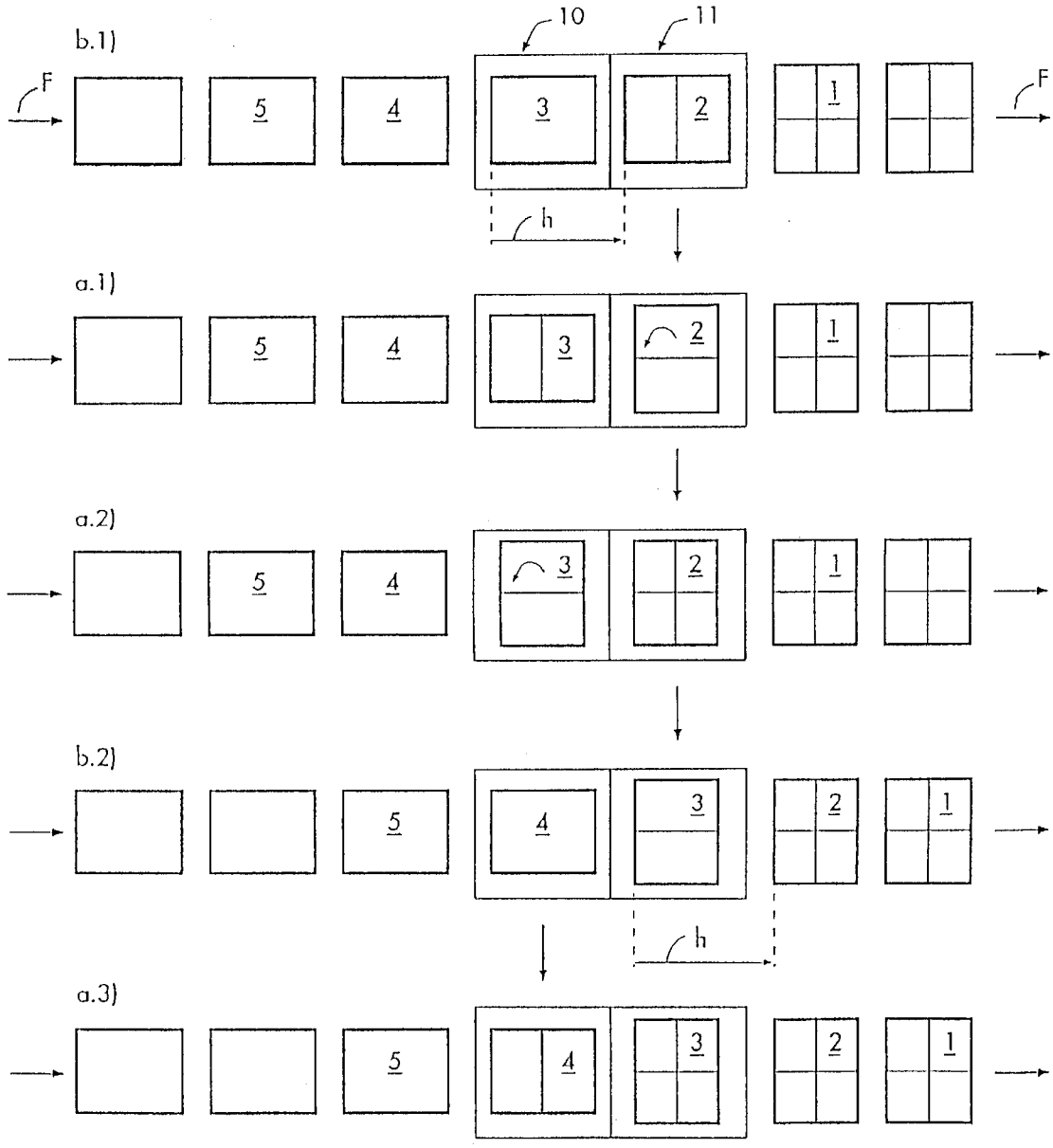
FIG. 3 shows a diagram of a further embodiment of the inventive method for operating an arrangement of cross-strapping devices (processing part-steps a.1, a.2, a.3 and conveying steps b.1, b.2)

FIG. 3 shows successive part-steps of a further operation mode for a tandem arrangement of two cross-strapping devices each of which is equipped with a part-device for transverse strapping (strapping perpendicular to the conveying direction) and a part-device for rotation of a package or a bundle. As mentioned to begin with, this kind of cross-strapping device is e.g. described in the publication DE-3248788. Two cross-strapping devices of the named kind may be operated in strapping steps and conveying steps as shown in FIG. 1. However, they can also be operated in strapping part-steps and intermediate conveying part-steps as shown in FIG. 3.

The strapping part-steps and conveying part-steps for crosswise strapping of two packages or bundles are the following:

b.1) conveying step for removing a package 1 from the second device 11, for moving a package 2 from the first device 10 into the second device 11 and for supplying a package 3 to the first device 10 (conveying stroke h the same as in single device operation);

a.1) strapping/rotating step for transverse strapping the package 3 in the first device 10 and for rotating the package 2 in the second device 11;

a.2) rotating/strapping step for rotating the package 3 in the first device 10 and for transverse strapping the package 2 in the second device 11;

b.2) conveying step similar to b.1) for packages 2, 3 and 4;

a.3 strapping/strapping step for simultaneous transverse strapping of the two packages 3 and 4.

The sequence of steps b.1, a.1, a.2, b.2, a.3 is repeated for further packages.

In the mutual operation mode according to FIG. 3 the conveying stroke which is necessary for the crosswise strapping of two packages or bundles in a tandem operation and which is double the size of the conveying stoke h of the single device operation is carried out in two part-strokes h which correspond to the stroke of the single device operation.

In the operating method according FIG. 3, the conveying steps are carried out in the same manner as in single device operation (stroke h). The processing is divided into processing part-steps carried out alternating with the conveying steps. For this reason, the operating method according to FIG. 3 (in opposition to the operating method according to FIG. 1) is only possible for processing devices in which processing is possible in successive processing part-steps.

Obviously, for all described methods for operating an inventive arrangement, it is possible, as for single device operation, to process each object in an individual manner, i.e. in particular repressing processing steps or part-steps for specific ones of the objects.

What is claimed is:

1. Method for operation of an arrangement of processing devices, each processing device comprising processing means, conveying means and individual control means, each processing device characterized as a device to which individual objects are supplied in series from one side, in which one object after the other undergoes processing and from which processed objects are conveyed away on the opposite side, and each processing device being equipped for conveying an object into the device by a conveying stroke in a conveying direction, for processing the object in the device and for conveying the object out of the device by a conveying stroke is said conveying direction, characterized in that a plurality of similar processing devices are arranged in direct succession such that the object conveyed away from an upstream device in said conveying direction is conveyed into the following device and that the arrangement comprises further control means controlling the arrangement and being superior to the individual control means, the method characterized in that the arrangement comprises at least two control modes: a first individual control mode in which processing steps are carried out alternating conveying steps with a conveying stroke, and a second mutual control mode in which all devices of the arrangement are controlled mutually and in which processing steps are carried out alternately with conveying steps, whereby in the second control mode the conveying stroke of the first control mode is multiplied by the number of devices arranged in the arrangement, or whereby in the second control mode in processing steps only part of the processing is carried out.

2. Method according to claim 1, characterized in that on failure of one of the processing devices (10, 11) the arrangement is automatically switched from the mutual to the individual control mode.

3. Method according to claim 1, characterized in that the processing devices (10, 11) are cross-strapping devices in which substantially parallelepipedic packages or bundles are strapped.

4. Method according to claim 3, characterized in that the crosswise strapping is carried out by strapping the packages or bundles perpendicular to the conveying direction (F), by rotating the packages or bundles by 90° and by again strapping the packages or bundles perpendicular to the conveying direction and that in the mutual control mode the crosswise strapping is carried out in the part-steps strapping/rotating (a.1), rotating/strapping (a.2) and strapping/strapping (a.3).

* * * * *